US005820005A

United States Patent [19]

Perkitny et al.

[11] Patent Number: 5,820,005

[45] Date of Patent: Oct. 13, 1998

[54] TAPE DISPENSER

[75] Inventors: Jerzy Perkitny, Bay Village; William W. Knox, Sr., Mentor; Brian A. Vulpitta, Avon Lake; Glenn M. Kaiser, North Olmsted, all of Ohio

[73] Assignee: Manco, Inc., Avon, Ohio

[21] Appl. No.: 785,377

[22] Filed: Jan. 21, 1997

Related U.S. Application Data

[63] Continuation of Ser. No. 391,115, Feb. 21, 1995, abandoned.

[51] Int. Cl.[6] ..... B65D 85/672

[52] U.S. Cl. ..... 225/65; 225/66

[58] Field of Search ..... 225/56, 61, 62, 225/63, 65, 66, 59, 26, 47, 78; 83/649; 221/70; 206/409, 408, 411; 242/532.1

[56] References Cited

U.S. PATENT DOCUMENTS

| | | | |
|---|---|---|---|
| D. 259,643 | 6/1981 | Pearson | D19/69 |
| D. 287,787 | 1/1987 | Dunchock | D3/35 |
| D. 323,187 | 1/1992 | Harris | D19/69 |
| 2,805,714 | 9/1957 | Vogt | 83/697 X |
| 2,815,125 | 12/1957 | Thompson | 225/91 X |
| 2,823,750 | 2/1958 | Vogt | 225/91 X |
| 3,972,459 | 8/1976 | Cooper | 225/47 |
| 4,106,962 | 8/1978 | Adams et al. | 156/73.1 |
| 4,358,328 | 11/1982 | Pearson | 225/65 X |
| 4,401,248 | 8/1983 | Helms | 225/47 |
| 4,588,469 | 5/1986 | Hunter | 156/527 |
| 4,627,560 | 12/1986 | Samuelson | 225/66 |
| 4,667,890 | 5/1987 | Pool | 242/422.5 |
| 4,667,891 | 5/1987 | Pool | 242/75.4 |
| 4,858,807 | 8/1989 | Cuek | 225/58 |
| 4,884,734 | 12/1989 | Kahl, Jr. et al. | 225/66 X |
| 4,937,032 | 6/1990 | Krone, Jr. et al. | 264/255 |
| 4,961,525 | 10/1990 | Corbo et al. | 225/65 |
| 4,998,655 | 3/1991 | Huang | 225/47 X |
| 5,024,670 | 6/1991 | Smith et al. | 623/18 |
| 5,071,051 | 12/1991 | Corbo et al. | 225/65 |
| 5,083,717 | 1/1992 | Samuelson et al. | 225/47 X |
| 5,123,582 | 6/1992 | Lo | 225/47 X |
| 5,123,583 | 6/1992 | Kato et al. | 226/74 |
| 5,363,997 | 11/1994 | Harris | 225/47 X |

*Primary Examiner*—Maurina T. Rachuba
*Attorney, Agent, or Firm*—Wickers, Daniels & Young

[57] ABSTRACT

A roll tape dispenser adapted to be made by injection molding is provided. The roll tape dispenser includes an integral molded frame, a generally planar tape guide portion, a pair of side walls extending rearwardly from the tape guide portion, a pair of hubs supported by each of the side walls, the hubs adapted to support a roll of tape having a selected inside radius of curvature, each hub comprising an arcuate top portion and two hub side portions. The hub side portions have surfaces which converge downwardly below a parting line on the frame and converge upwardly above the parting line whereby the dispenser can be molded in a slideless mold.

22 Claims, 3 Drawing Sheets

TAPE DISPENSER

This is a continuation of application Ser. No. 08/391,115 filed on Feb. 21, 1995, now abandoned.

FIELD OF THE INVENTION

This invention relates to tape dispensers made of molded material from which tape may be dispensed and severed from a roll of tape supported on the dispenser.

BACKGROUND OF THE INVENTION

A roll of tape generally consists of a long length of tape having adhesive on one side wound upon a cardboard core. The cardboard core is simply a cardboard cylinder having a uniform inside diameter and a uniform outside diameter. This supports the tape and provides circular openings on either side of the roll of tape for mounting upon a dispenser.

Dispensers of pressure sensitive adhesive tapes are well-known in the art and used widely by consumers and in many businesses. One type of dispenser comprises an integral molded plastic frame including a planar tape guide and a pair of side walls. Each of the side walls supports a hub. A roll of tape is supported on the hubs and the end portion of the roll of tape is supported upon the tape guide and severed by an edge at the end of the tape guide remote from the roll. The dispenser can be grasped by one hand while one uses the other hand to remove tape or hold the object being taped. Such dispensers are made in very large numbers as consumers will pay a premium for a roll of tape already mounted on a dispenser. Consumers want the dispensers to be easy to use and inexpensive. The dispenser and roll of tape should be easily grasped with the consumer having the ability to insert his fingers inside of the central core of the roll of tape during dispensing. Thus, the dispenser should not have closed side walls. The consumer also desires that the dispenser support the roll of tape in a stable manner so that tape is dispensed smoothly and controllably.

In order to be inexpensive, the dispenser must also be easy to manufacture. Many dispensers are made by the injection molding of plastics. In that process, two halves of a mold are brought together, a measured amount of heated plastic is injected into the cavities within the closed mold, the plastic is solidified through cooling or otherwise, the mold halves are separated and the finished parts ejected. For complex shapes, slides are sometimes used on the mold halves to define undercuts and the like. Slides and complex shapes limit the number of cavities one can put in a injection molding die. The less cavities one can use, the lower the production rate and the more expensive the product. The use of slides also lowers the production rate by increasing the cycle time between the ejection of finished parts in a mold and results in the finished product being more expensive.

One prior art dispenser consists of a single piece injection molded dispenser having a planar tape guide portion and two side walls. The side walls support short cylindrical inwardly facing hubs. The two hubs engage the outward end of the core of a roll of tape to be dispensed. This provides good support for the tape roll completely around its periphery. The dispenser has been successful. However, the dispenser is expensive to manufacture because it requires slides to define the cylindrical hubs.

Additionally, prior art dispensers do not consistently prevent tape from falling back upon the roll of tape after dispensing is complete. Typically, a piece of tape is fed from the tape roll to a serrated end portion of the dispenser by passing the strip of tape between the planar tape guide portion and tabs extending from the side walls beneath the tape guide portion. However, the tape often sags and slides between the tabs and falls back onto the tape roll. It then becomes necessary for the consumer to again find the end of tape on the tape roll in order to continue dispensing. When this occurs, often with clear carton tape, it is very difficult and nearly impossible for consumers to find the end. These consumers become very frustrated. As a result, consumer dissatisfaction is common. It is also very difficult or awkward for first time users of the tape to pull the tape through the guides and out to the serrated edge where it can be used.

Other dispensers are described in U.S. Pat. Nos. 4,961,525 to Corbo et al., 5,071,051 to Corbo et al., 4,627,560 to Samuelson; DES. 259,643 to Pearson; 4,358,328 to Pearson. Many other dispensers are also described in the art. Some of these dispensers are fairly inexpensive to manufacture. However, most of these do not support the tape roll adequately, do not prevent tape fall-back or otherwise are difficult to use and therefore less than ideal to consumers. Several others do provide good support for tape rolls but are therefore complex in design, require slides on the dies used in manufacturing or complex mold shapes and are therefore more expensive.

SUMMARY OF THE INVENTION

The present invention contemplates a new and improved tape dispenser of the type described above which overcomes all of the above referred to problems and others. The present invention provides a tape dispenser which has the stability needed to dispense and cut tape wound on a core and is inexpensive to manufacture.

Briefly stated, in accordance with the invention there is provided an integral molded tape dispenser having a generally planar tape guide portion, a pair of side walls extending rearwardly from the tape guide portion and a pair of hubs, one of said hubs supported by each of said side walls. The hubs each comprise an arcuate top portion and two side portions, one extending downwardly from each end of the top portion. The bottoms of the side portion are close to an imaginary circle which would be created if one extended the curve of the arcuate top portion. Additionally, two outwardly extending ribs also terminate close to this imaginary circle.

Further in accordance with the invention, the inside surfaces of the two downwardly extending side portions extend downwardly and outwardly with respect to vertical.

Still further in accordance with the invention, the outside surfaces of the downwardly extending sidewall below the outwardly extending ribs extend downwardly and inwardly a small amount with respect to vertical whereby the lower portion of the hub side portions can be injection molded without the use of slides.

Yet further in accordance with the invention, the outwardly extending ribs are positioned along a horizontal diameter of the imaginary circle described above whereby the ribs can be molded along the parting line of an injection molding die and no die slide portions are required.

Still further in accordance with the invention, the outside surfaces of the top half of the hub side portions converge upwardly and inwardly whereby no slides are required in manufacturing the hub.

Still yet further in accordance with the invention the tape guide portion includes an interconnecting portion between the pair of side walls and a tape retaining portion to prevent the tape from falling back upon the roll, the tape retaining portion including a first biasing portion cooperable with a second biasing portion for deflecting the tape between the first biasing portion and the second biasing portion.

Yet further in accordance with the invention, the first biasing portion is adapted to pivot relative to the interconnecting portion.

It is a principal object of the present invention to provide a tape dispenser having the necessary stability for use to dispense tape wound on a cylindrical core while maintaining a low cost for the dispenser.

It is another object of the invention to provide a tape dispenser which can be injection molded using relatively simple dies without slides, thus minimizing the cost of manufacturing.

It is still another object of the present invention to provide a tape dispenser having tape hubs supporting the inside surface of a tape core at multiple positions around the core circumference.

It is yet another object of the present invention to provide a tape dispenser having hubs which provide support for a tape core at its top and at positions close to the bottom of the tape core inexpensively.

Yet another object of the present invention is to provide a tape dispenser having an improved tape guide portion to prevent fall back of the tape onto the roll.

Still yet another object of the present invention is to provide a tape dispenser having an improved tape guide portion which is easy to use and reduces consumer dissatisfaction.

Further objects and advantages of the invention will be apparent from the following detailed description of a preferred embodiment thereof and from the accompanying drawings.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

PREFERRED EMBODIMENTS

Figure 1:
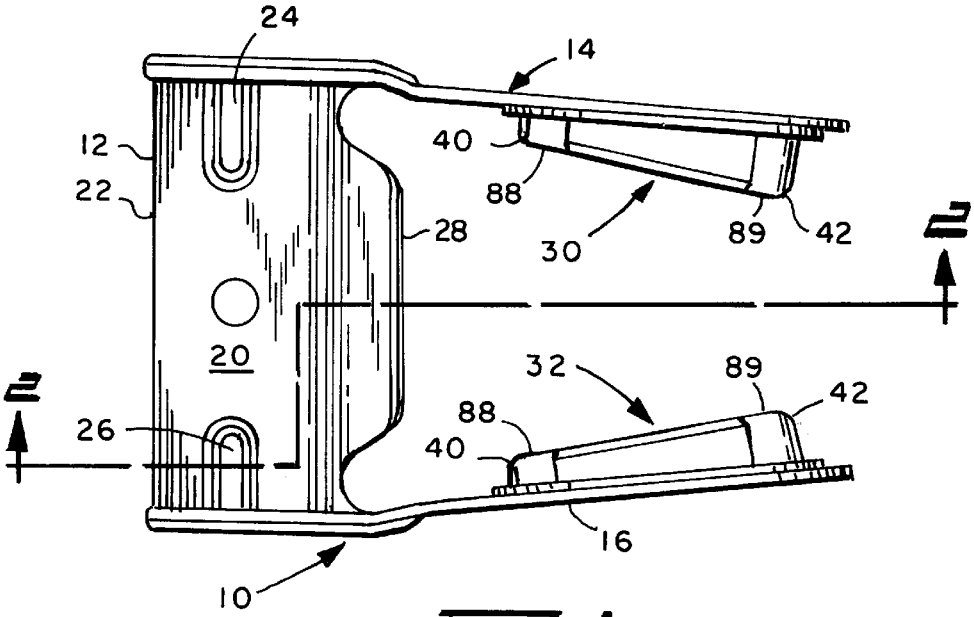
FIG. 1 is a plan view of the tape dispenser according to the invention prior to installation of a roll of tape.

Referring now to the drawings wherein the showings are for the purposes of illustrating a preferred embodiment of the invention only and not for the purposes of limiting same, the FIGURES show a tape dispenser 10 for a roll of tape 18 (FIG. 3) such as a pressure sensitive adhesive-coated tape wound upon a cardboard cylindrical core 19. Such rolls of tape come in various sizes. Rolls of tape often have inside core diameters of a nominal one and one-half inches or a nominal three inches. Other sizes are also available.

As can be seen in FIG. 1, the dispenser 10 is comprised of a planar tape guide portion 12 and two side walls 14, 16. The side walls 14, 16 are mirror images of one another and the dispenser as a whole is symmetrical with the right side being a mirror image of the left side. The tape guide portion 12 is conventional in construction. It is formed with a planar crosspiece 20 interconnecting the two side walls 14 and 16. At the front of the crosspiece 20 is a tape cutting edge 22. This is normally formed by a serrated metal blade attached to the crosspiece in an conventional manner. Two tape retaining tabs 24, 26 are spaced slightly below the crosspiece 20. When a piece of tape is fed through the tape guide portion 12, it is normally fed below the crosspiece 20 and above the tape retaining tabs 24, 26. The tabs will retain the tape end portions and prevent it from falling back upon the roll of tape. A central crosspiece extension 28 extends rearwardly, that is, towards the position of the roll of tape, from the crosspiece 20. This extension 28 provides a convenient place to hold the dispenser during tape dispensing operations. The side walls 14, 16 extend rearwardly well beyond the crosspiece extension 28. The side walls 14, 16 are angled somewhat toward one another, preferably about five degrees, rather than parallel to one another to provide a gripping action on the roll of tape to be dispensed. All of the above described structures are conventional.

Two hubs 30, 32 are supported on the side walls 14, 16. The hubs 30, 32 are mirror images of one another. Hub 30 can be seen in greater detail in FIG. 2. The hub 30 is comprised of an arcuate top portion 34 a forward hub side portion 36, a rearward hub side portion 38, a forward horizontal rib 40 and a rearward horizontal rib 42. Surrounding the hub 30 is a side wall raised portion 44 having a circular outer edge 46. The raised portion 44 provides a bearing surface against which the side of a tape core may slide. Just inside of the outer edge 46 is a dashed circle 48 showing the normal position of the inside of a tape core 19 as seen in FIG. 3.

The hub top portion 34 is arcuate and has a uniform radius of curvature over most of its length. The uniform radius of curvature is somewhat smaller than the radius of curvature of the dashed circle 48 representing the inside surface of the tape core 19 (FIG. 3). The top portion 34 therefore provides a good support surface for the tape core 19. The forward hub side portion 36 is joined to the top portion 34 by a smooth curve 50. A similar smooth curve 52 joins the hub top portion 34 to the rearward hub side portion 38. The forward hub side portion 36 extends downwardly and terminates at a rounded bottom tip 53. The rearward hub side portion 38 also extends downwardly and terminates in a similar rounded bottom tip 54.

Figure 2:
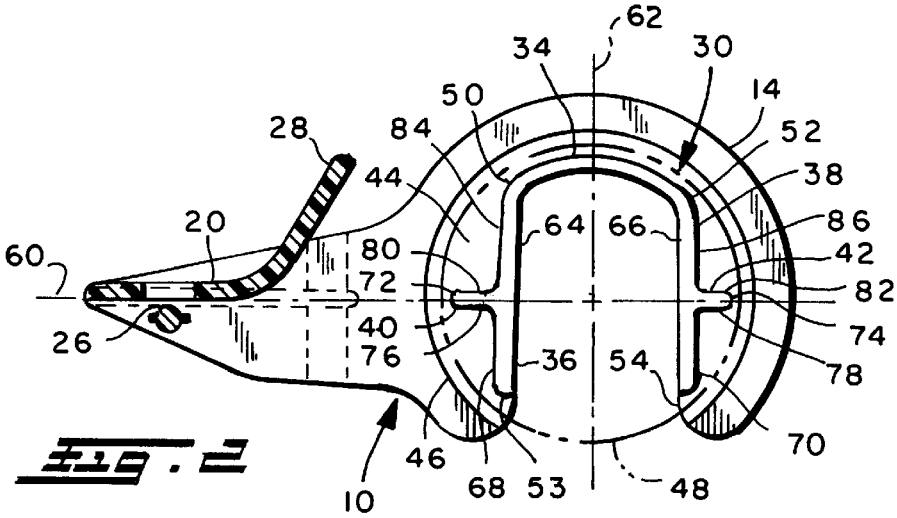
FIG. 2 is a cross sectional view of the tape dispenser of FIG. 1 taken along line 2—2 of FIG. 1.
Figure 3:
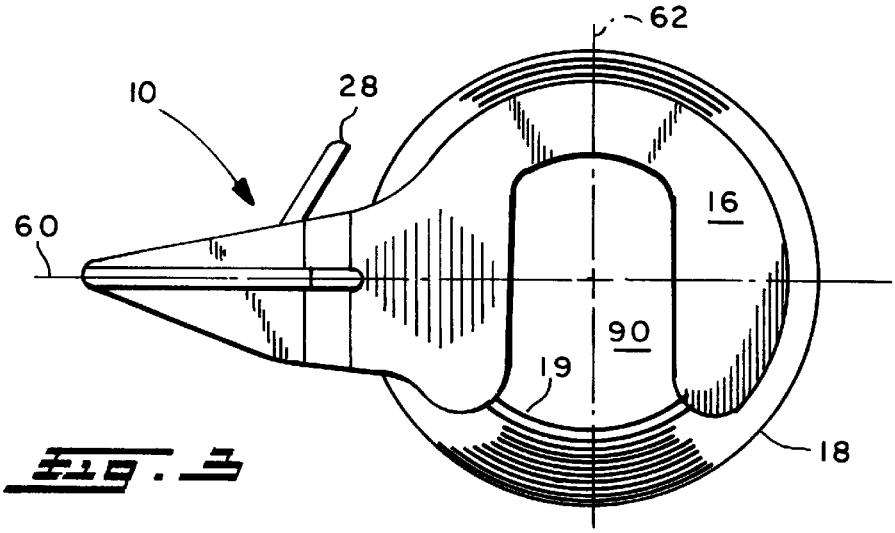
FIG. 3 is a side elevational view of the tape dispenser of FIGS. 1 and 2 with a roll of tape mounted on the dispenser.

A dashed horizontal line 60 as seen in FIG. 2 extends through the entire dispenser. This dashed line shows the parting line of the two mold halves used to form the dispenser 10. On a finished part, dashed line 60 would likely not been seen. If seen at all, dashed line 60 would be seen as the remnants of a slight flash line from the molding process. A vertical dashed line 62 crosses the horizontal dashed line 60 at the center of the raised portion outer edge 46 and the dashed circle representing the tape core inside 48. The hub 30 is symmetrical about this vertical line 62.

As can be best seen in FIG. 2, the inside surface 64 of the forward hub side portion 36 diverges slightly outwardly and downwardly away from the center line 62. In the preferred embodiment, this diversion is less then five degrees and is selected to be one degree. The inside surface 66 of the rearward hub side portion 38 also diverges outwardly and downwardly at approximately one degree.

The lower outside surface 68 of the forward hub side portion 36 converges downwardly and inwardly toward the vertical dashed line 62. Similarly the lower outside surface 70 of the rearward hub side portion 38 converges inwardly and downwardly toward the vertical dashed line 62. The convergence is less than five degrees and preferably about one degree. The combination of divergence of the inside surfaces 64, 66 and convergence of the outside surfaces 68, 70 provides a slight downward taper to the lower halves of the forward hub side portion 36 and the rearward hub side portion 38. This allows for a simplified mold design.

The forward rib 40 extends outwardly of the forward hub side portion 36 along the parting line 60. It has a rounded outboard tip 72 near the circle 48. Likewise, the rearward rib 42 extends outwardly of the rearward hub side portion 38 and has a rounded outboard tip 74 near the circle 48. Both the rib 40 and the rib 42 have substantially planar lower surfaces 76, 78 and substantially planar upper surfaces 80, 82, and two rib edges 88, 89 extending therebetween. Above the rib 40, the upper outside surface 84 of the forward hub side portion 36 converges upwardly and inwardly toward the vertical line 62 at about one degree and is generally parallel to the inside surface 64 of the forward side hub side portion 36. The upper outside surface 86 of the rearward hub side portion 38 similarly converges upwardly and inwardly toward the vertical line 62 at about one degree. As can be best seen in FIG. 2, this configuration allows for molding without slides and relatively simpler injection molding dies. In other words, the hub surfaces 84, 86 above the parting line all diverge outwardly and downwardly, with respect to line 62, to the parting line 60. A part molded with this shape is easily ejected without the necessity to move a slide. Similarly, the portions below the parting line 60 all are easily ejectable from a mold without having to move a slide.

The top surface of the top portion 34, the rib outboard tips 72, 74 and the side portion bottom tips 53, 54 are all disposed close to the dashed circle 48 identifying the inside surface of the tape core 19. While some clearance is provided, substantial support is also provided. Importantly, the tips 53, 54 extend downwardly to near the bottom of the circle 48 and the rib outboard tips 72, 74 extend almost to the core on the horizontal diameter. This prevents distortion of the tape core 19 and also prevents vertical translation of the tape core 19 during dispensing so that smooth dispensing can be accomplished. In prior units supporting a tape core only over its top half or the like, the tape core could become distorted or pushed upwardly resulting in jamming and uneven dispensing.

As best seen in FIG. 3, the tape dispenser tab provides an access opening 90 in the side wall 16. The access opening 90 passes completely through the dispenser and is mirrored in the side wall 14. When a roll of tape 18 is mounted on the dispenser 10, the opening 90 is still open. This provides a convenient place for a consumer to grasp the dispenser 10 and roll of tape 18. A finger or two can be passed through the opening 90 on one side and the thumb passes through the opening 90 on the other side. This is a preferred holding mechanism for many consumers.

As can be seen in FIG. 1, the hubs 30 and 32 are tapered from a horizontally wider rearward rib 42 to a horizontally narrower forward rib 40. This minimizes the amount of flexing required of the sidewall to mount or dismount a roll of tape. Additionally, forces in dispensing are almost always exerted on the rearward rib 42 and side portion 38 during dispensing so the forward rib 40 and forward side portion 36 can be made less wide and still accomplish the purpose intended.

Figure 4:
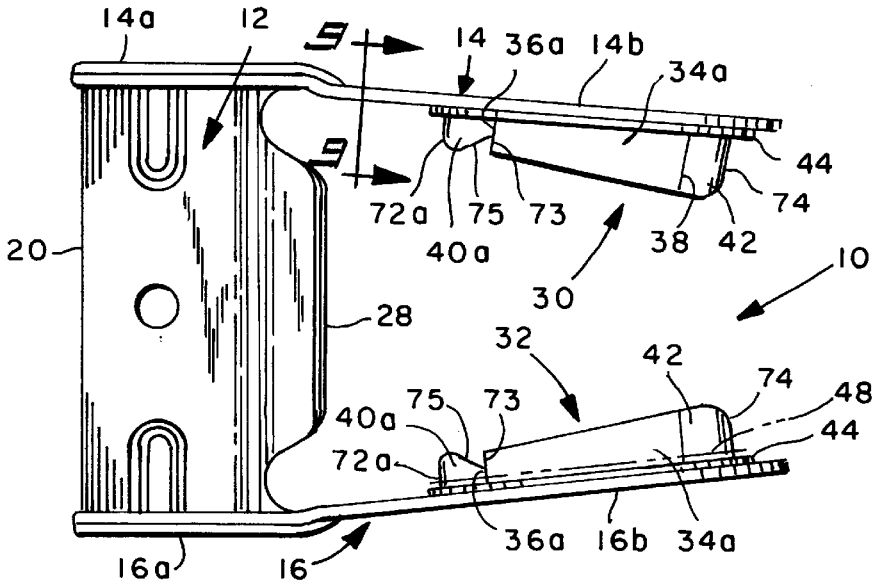
FIG. 4 is a plan view of an alternative embodiment of the tape dispenser of FIG. 1.
Figure 5:
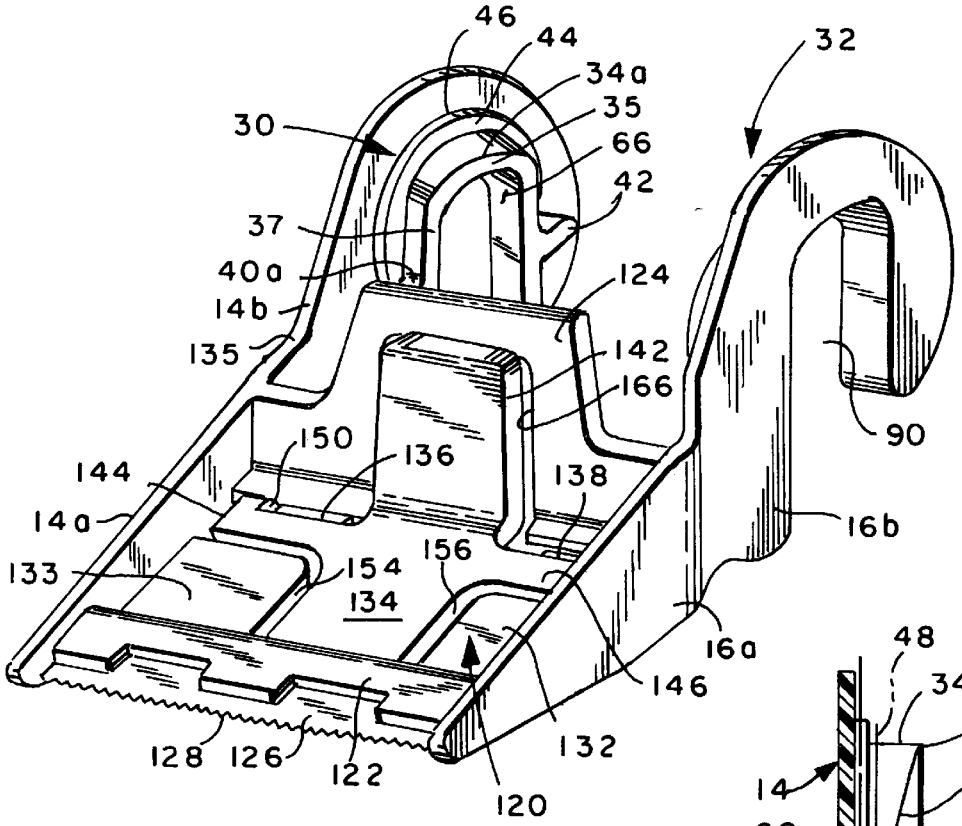
FIG. 5 is a pictorial view of another embodiment of the tape dispenser of FIG. 1.
Figure 9:
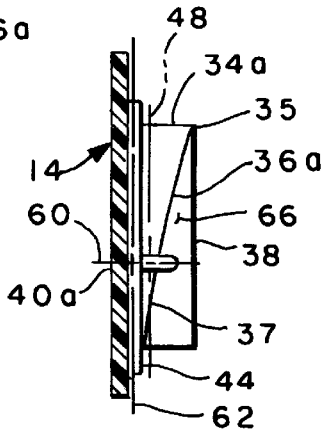

A second embodiment of the invention is shown in FIGS. 4 and 9. This embodiment better facilitates loading a roll of tape (not shown) on dispenser 10 during a packaging process. The tape guide portion 12 of the second embodiment is identical to that described with reference to FIGS. 1–3. The side walls 14, 16 each include front sidewall portions 14*a*, 16*a* and rear sidewall portions 14*b*, 16*b*. Particularly, the hubs 30, 32 are modified and described hereinbelow. During packaging, a roll of tape (like that shown in FIG. 3) is mounted (loaded) on each dispenser 10 in automated, high speed packaging equipment (not shown). The side walls 14*b*, 16*b* are spread, a roll of tape inserted and the side walls are relaxed, holding the roll of tape.

In the prior art, if a roll of tape jams against a tape dispenser during packaging or loading, the high speed packaging and loading equipment is often stopped and production is lost. Jamming sometimes occurs when a roll of tape impacts against one of the side walls of prior art dispensers, particularly a hub portion. Protruding surfaces of prior art dispensers are more likely to cause a jam, rather than surfaces protected by other surfaces. Automated loading machines insert tape rolls onto a dispenser from the upper rear. The novel hubs 30, 32 shown in FIGS. 4 and 9 minimize jamming in this operation.

The elements of the hubs 30, 32 seen in FIGS. 1–3 are present in the embodiment of FIGS. 4 and 9 except as specifically shown. The rearward hub side portion 38 remains the same as in FIGS. 1–3. The top portion 34*a* is modified by having a slightly more pronounced taper from between a forward hub side portion 36*a* and the rearward hub side portion 38. The forward hub side portion 36*a* is modified by being tapered from a widest point at top portion 34*a* to a point at which it merges with raised portion 44, said point being below toward rib 40*a* as seen in FIG. 9. The top of the forward hub side portion 36*a* has an inside edge 37 continuous with an inside edge 35 of the top portion 34*a*. The inside edge 37 is angled inwardly with respect to the side wall 14 such that at the bottom of the forward hub side portion 36*a*, the inside edge 37 merges with the raised portion 44 of the side wall 14. Thus, the forward hub side portion 36*a* is tapered downwardly to essentially vanish at its bottom.

The forward rib 40*a* is modified to be tapered from an outboard tip 72*a* to a narrower inboard end 73. The inside edge 75 of the rib 40*a* is angled (FIG. 4) to provide the taper from the outboard tip 72*a* to the narrower inboard end 73. The inside edge 75 at the inboard end 73 is continuous with the inside edge 37 of the forward hub side portion 36*a* where these two elements join.

The above described structure minimizes the portions of the forward hub side portion 36*a* which cause jams. When the side walls 14, 16 are spread and a roll of tape inserted, the forward hub side portions 36*a* are sheltered behind the rearward hub side portions 38 and top portion 34*a*. The portion most likely to cause a jam, the lower half of the forward hub side portions are almost eliminated. Because of the reverse taper of the forward rib, the outboard tip 73*a* remains full width and can support the tape roll for dispensing. The anti-jam feature is accomplished without compromising the dispensing function.

FIGS. 5–8 disclose a third embodiment of the invention. The two hubs 30, 32 including the rear side wall portions 14*b*, 16*b* are identical to the embodiment shown in FIGS. 1–3 with the modifications shown in FIG. 4 and 9. The tape guide portion 120 is somewhat wider than the guide portion of FIGS. 1–3 and extends between the front side wall portions 14*a*, 16*a* which are generally parallel to one another. The tape guide portion 120 includes an interconnecting crosspiece 122 and a separate central crosspiece 124, both extending between side wall portions 14*a* and 16*a*. The interconnecting crosspiece 122 is generally horizontal. The interconnecting crosspiece 122 is adapted to be fitted with a serrated metal blade 126 at its front end to form a tape cutting edge 128. Rearward of the metal blade 126, the crosspiece 122 has a vertical downwardly extending portion 123. Extending horizontally from the bottom of the vertical portion 123 of the interconnecting cross piece 122 is a cantilever 134, attached to the interconnecting cross-piece 122 at a cantilever axis A-A. The cantilever 134 is narrower than the central crosspiece 124 and is centered between the two side walls 14, 16.

The cantilever 134 includes two extension arms 144, 146 extending toward the side walls 14, 16. The ends of the extension arms 144, 146 adjacent the side walls 14, 16 have downwardly extending vertical portions 150, 152 which are parallel to and just inside the side walls 14, 16. The bottom of the vertical portions 150, 152 support inwardly extending horizontal retaining tabs 136, 138. An upward extending finger tab 142 is connected to the cantilever 134.

Figure 6:
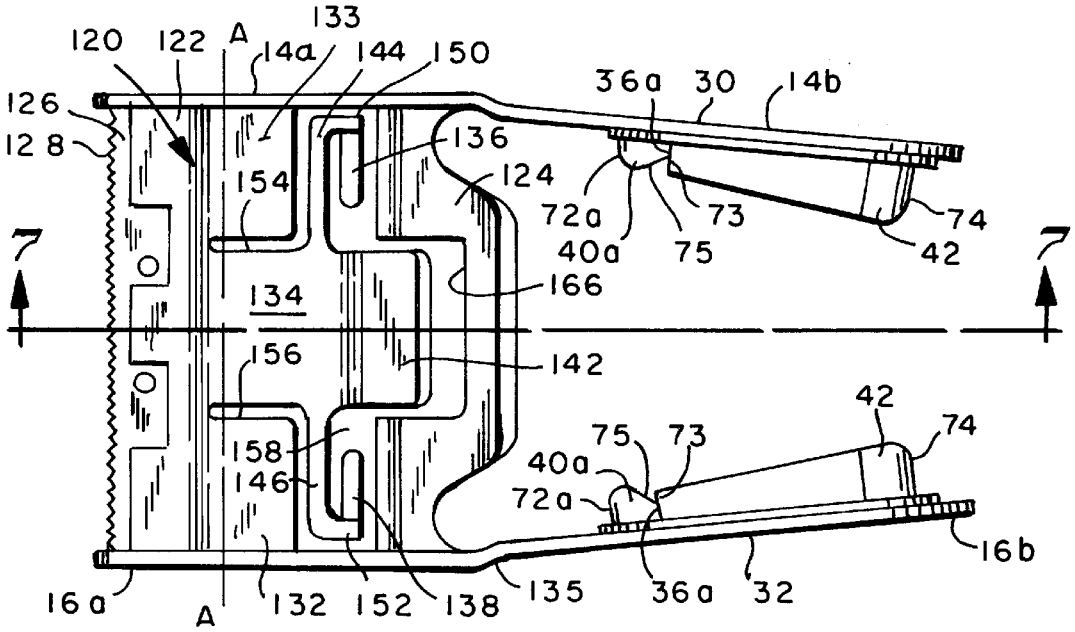
FIG. 6 is a plan view of the tape dispenser of FIG. 5.

As can be seen in FIG. 6, the tabs 136, 138 are offset toward the hubs 30, 32. No portion of the tabs is directly under any portion of the extension arms. This allows molding without use of slides.

The interconnecting crosspiece 122 includes a pair of notches 154, 156 which separate the cantilever 134 from two horizontal flanking areas 132, 133. In the preferred embodiment, the notches 154, 156 extend into the vertical portion 123 providing additional flexibility to the cantilever 134. The flanking areas are generally coplaner with the cantilever 134.

A gap 158 exists between the cross piece 122 and the central cross piece 124. As can be seen in FIG. 6, the extension arms 144, 146, vertical portions 150, 152 and tabs 136, 138 are located in this gap. This facilitates molding without slides.

The central crosspiece 124 is generally L-shaped. It includes a generally vertical portion 162 and a shorter generally horizontal portion 164. The central crosspiece 124 has an opening 166 which will accommodate the finger tab 142 when finger tab 142 is displaced.

Figure 7:
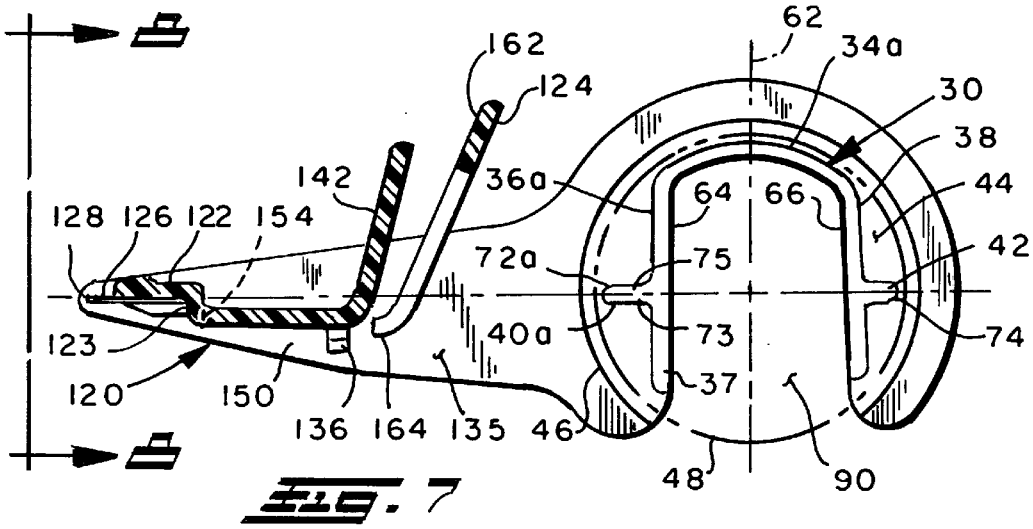
FIG. 7 is a cross-sectional view taken along line 7—7 of the tape dispenser of FIG. 6.
Figure 8:
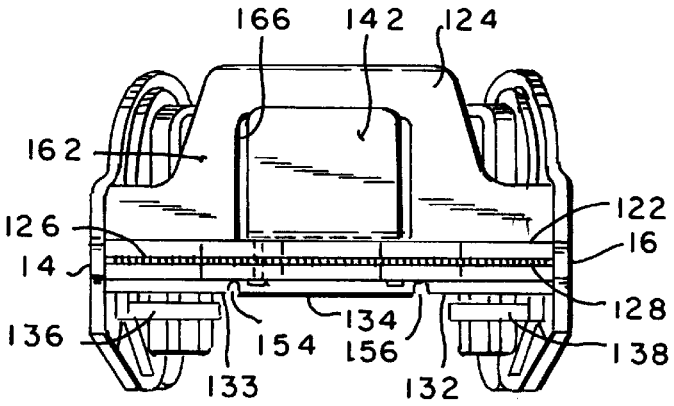
FIG. 8 is a front elevation view taken along line 8—8 of the tape dispenser of FIG. 7; and, FIG. 9 is an elevational view of the dispenser taken along line 9—9 of FIG. 4.

Operation of the tape guide portion 120 to prevent fall back of the severed end of a roll of tape onto the tape roll is accomplished in the following manner. It will be appreciated that a tape roll as represented by the inside diameter of the tape core 48, as shown in FIG. 7, is mounted on hubs 30, 32. Tape is fed from the tape roll, below the central crosspiece 124 and the interconnecting crosspiece 122 and above the tape retaining tabs 136, 138 to the tape cutting edge 128. As shown in FIGS. 7 and 8, cantilever 134 is shown depressed as in a deflected or biased state. Tape is dispensed by the operator depressing the finger tab 142 and moving tape dispenser about a package. Depressing the finger tab 142 moves the tape retaining tabs 136, 138 downwardly and allows tape to pass between the tabs 136, 138 and the horizontal portion 164 of the central crosspiece 124. When dispensing is completed, the tape is cut on the edge 128 and the finger tab 142 is released. The tape retaining tabs 136, 138 spring upwardly into a relaxed state. The top surfaces of the tabs 136, 138 are then higher than the bottoms of horizontal portion 164 of the central crosspiece 124. The tape is spring biased into contact with these surfaces and held in place until the finger tab 142 is again depressed.

The geometry of tape guide portion 120 has at least three distinct advantages over prior art integrally molded plastic tape dispensers. The first is that the tape will not fall back upon the roll once it has been separated from the package since the binding action between tabs 136, 138 and the horizontal portion 164 of the central crosspiece causes the tape to adhere to tape retaining tabs 136, 138. Second, the tape which has been applied is more easily separated from tape dispenser 118 at tape cutting edge 128. This separation is made easier with the improvement described herein, since the tape is made taut and fixed by the binding action. Thus, the tape does not continue to pay out from the tape roll as an operator attempts to cut the tape with metal blade 126. Third, the improvements are made by producing an integrally molded plastic dispenser which can be injection molded without the use of slides. This decreases production costs while increasing customer satisfaction by reducing fall-back of tape onto the tape roll.

The invention has been described with reference to the preferred embodiments. It will be appreciated that modifications or alterations could be made without deviating from the present invention. Such modification and alterations will occur to others upon the reading and understanding of the specifications. It is intended that all such modifications and alterations be included insofar as they come within the scope of the appended claims or the equivalents thereof.

Having thus described the invention, it is claimed:

1. A roll tape dispenser comprising an integral molded frame having a generally planar tape guide portion, a pair of side walls which extend longitudinally rearward from said tape guide portion, and a pair of hubs, each one of said pair of hubs having a transversely extending vertical line about which each one of said pair of hubs is generally symmetrical, each one of said pair of hubs supported by one of said pair of side walls for supporting a roll of tape, each one of said pair of hubs comprising an arcuate top portion extending from one of said pair of side walls, two hub side portions transversely extending downward from said arcuate top portion and outwardly from each one of said pair of side walls, said arcuate top portion having a radius of curvature generally on a circle symmetrical about said vertical line, each of said two hub side portions having an inside surface and an opposite outside surface, said inside surface and said outside surface generally perpendicular to said side walls, said inside surface of one of said two hub side portions facing said inside surface of the other of said two hub side portions, each said inside surface extending transversely downward and diverging longitudinally from said vertical line, said two hub side portions terminating opposite said arcuate top portion and near said circle, and each one of said pair of hubs including first and second ribs, said first and second ribs extending outwardly from each one of said two hub side portions and longitudinally extending to a point near said circle.

2. The dispenser of claim 1, wherein said two hub side portions are generally parallel to said vertical line.

3. The dispenser of claim 2, wherein said first and second ribs are generally longitudinally aligned perpendicular to said vertical line.

4. The dispenser of claim 2, wherein each said inside surface of said two hub side portions diverges from said vertical line by between one and five degrees.

5. The dispenser of claim 4, wherein each said inside surface of said two hub side portions diverges from said vertical line by about one degree.

6. The dispenser of claim 1, wherein each said outside surface transversely extends downward and longitudinally diverges from said vertical line above said first and second ribs and transversely extends downward and converges on said vertical line below said first and second ribs.

7. The dispenser of claim 1, wherein each said pair of side walls include an opening between said two hub side portions.

8. The dispenser of claim 1, wherein each said pair of side walls include an opening between each said inside surface.

9. The dispenser of claim 1, wherein each of said two hub side portions are tapered below said first and second ribs, each said inside surface and opposite outside surface converging.

10. A roll tape dispenser made by injection molding comprising an integral molded frame having a parting line, a generally planar tape guide portion, a pair of side walls longitudinally extending rearward from said tape guide portion, a pair of hubs supported by each of said side walls adapted to support a roll of tape, each said hub comprising an arcuate top portion and two hub side portions, said portions extending outwardly from said pair of side walls, said side portions having surfaces which are longitudinally converging below said parting line, and surfaces which are longitudinally converging above said parting line whereby said dispenser can be molded in a slideless mold.

11. The dispenser of claim 10, including ribs extending outwardly from said side portions, said ribs positioned at said parting line.

12. The dispenser of claim 11, wherein each said side wall each includes an opening between said two hub side portions.

13. The dispenser of claim 10, wherein said converging surfaces below said parting line converge as said surfaces extend away from said parting line.

14. The dispenser of claim 13, wherein said converging surfaces above said parting line converge as said surfaces extend away from said parting line.

15. The dispenser of claim 10, wherein said converging surfaces above said parting line converge as said surfaces extend away from said parting line.

16. A roll tape dispenser comprising an integral molded frame having a generally planar tape guide portion, a pair of side walls extending longitudinally rearward from said tape guide portion and a pair of hubs, said pair of side walls including a pair of front side wall portions adjacent said tape guide portion, and an opposite pair of rear side wall portions extending longitudinally rearward from said pair of said front side wall portions, each one of said hubs supported by one of said side walls, said hubs adapted to support a roll of tape having a selected inside radius of curvature, each said hub comprising an arcuate top portion extending from one of said pair of side walls and having an inside edge and a radius of curvature, said radius of curvature continuing to define a circle, said top portion being less than a complete semicircle, each of said two hubs further including two hub side portions extending from one of said pair of side walls, said two hub side portions each having an inside surface and an outside surface, each of said inside surfaces transversely extending downward from said arcuate top portion and terminating opposite said top portion and near said circle formed by said continuation of said radius of curvature, said inside surfaces and said outside surfaces having inside edges extending therebetween, one of said inside edges tapering and converging toward said side wall, first and second ribs outwardly extending from each said side wall, said first and second ribs each longitudinally extending from one of said outside surfaces, each said first rib including a first tip opposite said one of said outside surfaces and adjacent said circle and a first rib edge longitudinally extending between said first tip and said one of said outside surfaces, each said second rib including a second tip opposite the other of said outside surfaces and adjacent said circle and a second rib edge longitudinally extending between said second tip and said other of said outside surfaces, each said first rib edge tapering from said first tip and converging toward said rear side wall adjacent said outside surface.

17. The dispenser of claim 16, wherein each said first rib has a length extending outwardly from said one of said pair of side walls, said length being along said outside surface and coextensive with said outside surface, said first tip having a length, said length of said first tip being greater than said length of said first rib.

18. The dispenser of claim 17, wherein each said first rib is a forward rib adjacent said tape guide portion.

19. The dispenser of claim 16, wherein said one of said inside edges tapering and converging toward said side wall is continuous with said inside edge of said top portion at a first end and tapers from said first end to converge with said side wall at a second end.

20. The dispenser of claim 19, wherein said one of said inside edges tapering and converging toward said side wall is a forward inside edge adjacent said tape guide portion.

21. A roll tape dispenser adapted to be made by injection molding comprising an integral molded frame having a parting line, a tape guide portion at a front end of said frame, a pair of side walls extending longitudinally rearward from said tape guide portion, and a pair of hubs at a rearward end of said frame, said hubs supported by said side walls, said hubs adapted to support a roll of tape, said tape guide portion including means for interconnecting said pair of side walls and tape retaining means for preventing said tape from falling back upon said roll, said tape retaining means having surfaces above said parting line and below said parting line, whereby said dispenser can be molded in a slideless mold.

22. A roll tape dispenser for supporting a roll of tape comprising:

an integral molded frame having a generally planar tape guide portion, a pair of side walls which extend longitudinally rearward from said tape guide portion, and a pair of hubs, each one of said pair of hubs having a transversely extending vertical line about which each one of said pair of hubs is generally symmetrical, each one of said pair of hubs supported by one of said pair of side walls, each one of said pair of hubs comprising a top portion extending outwardly downward from said top portion and outwardly from each one of said pair of side walls and two hub side portions transversely extending downward from said top portion and outwardly from each one of said pair of side walls, said two hub side portions having an inside surface and an opposite outside surface, said inside surface and said outside surface both being generally perpendicular to said side walls, said inside surface of one of said two hub side portions facing said inside surface of the other of said two hub side portions, each said inside surface extending transversely downward and diverging longitudinally from said vertical line, said two hub side portions terminating opposite said top portion, and each one of said pair of hubs further including first and second ribs, said first and second ribs extending outwardly from each one of said pair of side walls and extending longitudinally from each one of said two hub side portions.

* * * * *